US006093047A

United States Patent [19]

Ann

[11] Patent Number: 6,093,047

[45] **Date of Patent: *Jul. 25, 2000**

[54] SLOT TYPE TERMINAL AND THE TERMINAL BLOCK PROVIDED WITH THE SAME

[76] Inventor: Young Sook Ann, 310-101, Kookjae Hanjin Apartment, Hindol Maul, 1349, Baeksuk 2 dong, Koyang-si, Kyungki-do 411-360, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 08/737,195

[22] PCT Filed: May 4, 1995

[86] PCT No.: PCT/KR95/00048

§ 371 Date: Nov. 6, 1996

§ 102(e) Date: Nov. 6, 1996

[87] PCT Pub. No.: WO95/31015

PCT Pub. Date: Nov. 16, 1995

[30] Foreign Application Priority Data

May 7, 1994 [KR] Rep. of Korea ..... 94-10120

[51] Int. Cl.[7] ..... H01R 13/40

[52] U.S. Cl. ..... 439/398; 439/417; 439/395

[58] Field of Search ..... 439/397–400, 439/404, 405, 409, 410, 417, 395, 396

[56] References Cited

U.S. PATENT DOCUMENTS

| | | | |
|---|---|---|---|
| 2,408,045 | 9/1946 | Cottrell | 439/409 |
| 3,964,816 | 6/1976 | Narozny | 439/397 |
| 4,074,929 | 2/1978 | Krider | 439/398 |
| 4,109,991 | 8/1978 | Evans | 439/398 |
| 4,256,360 | 3/1981 | Debaight | 439/400 |
| 4,296,988 | 10/1981 | Warner | 439/398 |
| 4,354,719 | 10/1982 | Weidler | 439/398 |
| 4,773,875 | 9/1988 | Huiskes | 439/395 |
| 5,022,867 | 6/1991 | Kourimsky et al. | 439/395 |
| 5,088,934 | 2/1992 | Chow et al. | 439/395 |
| 5,295,857 | 3/1994 | Toly | 439/417 |
| 5,683,266 | 11/1997 | Guidi et al. | 439/395 |

FOREIGN PATENT DOCUMENTS 333356 11/1976 Australia .

*Primary Examiner*—Paula Bradley
*Assistant Examiner*—Tho Dac Ta
*Attorney, Agent, or Firm*—Andrus, Sceales, Starke & Sawall

[57] ABSTRACT

The present invention provides a slot type connecting terminal (40) which may make a connection between the conductor material (Wc) of the insulated conductor (W) and the slot (42) by penetration into the insulation of conductor and contacting the conductor material therewith in the area at least half a circle of the arcuate, by weighing down of the conductor after setting the insulated conductor into the slot (42) of terminal (40), and the slot having semi-circular knife edge profile in at least the lower part thereof will penetrate and make a contact area between them. The cover (20) and the terminal block body (30) have respective conductor receiving groove (23, 33) to securely hold the connected conductor in place. The cover has a scoring line (24) formed in transverse direction to the length of the cover by cutting off a part of its height, leaving thin film at the scoring line such that the scoring line will act as a snap hinge (25). Since only the movable portion of the cover is snappingly engaged by the hooks (36, 38) provided in the terminal block body (30), access into the connected conductor within the terminal body can be made by simply turning up the movable portion of the cover (20) when connecting the conductor or during inspection or maintenance of the connection.

7 Claims, 8 Drawing Sheets

SLOT TYPE TERMINAL AND THE TERMINAL BLOCK PROVIDED WITH THE SAME

BACKGROUND OF THE INVENTION

1. Field of the Invention

The present invention relates in general to an improvement of slot type electrical terminals and more particularly to the electrical terminal blocks employing slot-type terminals.

2. Description of the Prior Art

Generally, terminal blocks employing electrical terminal contacts, are used in great variety and numbers in communication equipment to facilitate electrical connection of insulated electrical conductors to the contacts in the data processing system and harness thereof as well as to other conductors. In the past, the electrical connection has been accomplished by stripping the insulation from one end of the conductor and then soldering the conductor to the terminal contacts.

As a method of connecting an insulated conductor into a contact of a conductor terminal, there has been proposed soldering of the conductor material to the contact. However, this procedure requires considerable skill on the part of the workmen making the solder connection and is somewhat cumbersome and time consuming. In order to overcome these disadvantages, terminal blocks employing insulation-penetrating slot-type terminal contacts have been developed. The slot type terminal includes a pair of electrically conductive vertical blades, "each having a slot", or "forming slot therebetween" at free ends thereof as a contact. The construction of blades permits electrical connection simply by penetrating the insulation of conductors. The penetration into the insulation is obtained by compressive forces applied to the conductors during seating of the wire in the terminal contact slot without stripping the insulation. In this slot-type terminal, problems may arise during the insertion procedure in that the crimping action of the slot to the conductor material requires that the conductor be restrained from flexing at this point so as not to damage the conductor. The flexing may cause degradation of the conductor material which ultimately results in its breaking off.

The conventional conductor connecting terminal will be described hereinbelow with reference to FIG. 1 to 3.

FIG. 1 shows an exploded view of the conventional connector block provided with the slot type terminal block. W denotes the insulated conductor, reference number 1 denotes terminal block body, 2 denotes the conductor connecting terminal included in the terminal block body, and 3 denotes the cover thereof.

FIG. 2 shows the cross sectional view of the insulated conductor. Wc denotes insulated conductor, D denotes the diameter of the conductor material, and Wi denotes the insulation of the conductor.

FIG. 3 shows the perspective view of the conventional slot-type connecting terminal, finished with connection of the related insulated conductor, widely used in the terminal block shown in FIG. 1.

With reference to FIG. 1, a terminal block body 1 which allows connection of plurality of conductors has a plurality of recesses 4 for accepting related insulated conductor connecting terminals 2 in the shape of conductive strip material. As can be seen in FIG. 3, each of the connecting terminals 2 is comprised of an elongated rectangular base portion 5, a pin connector portion (not shown) extending at one end of said base portion, and a pair of upstanding blades 6 and 6, first blade 6 being extended upwardly at the other end of the base portion 5 and second blade 6 being extended upwardly and in parallel with said first blade at a distance therefrom. The upstanding blades 6 and 6 have respective U-shaped slots 8 in the vicinity of the center of the free end thereof provided with a pair of downwardly converging and oppositely disposed tapered edges 7 and 7. Said edges 7 and 7 form a pair of knife edges with sharp-edged blade therebetween. Since the distance between opposite knife edges substantially equals the diameter of the conductor Wc, depressing the insulated conductor into the slot 8 results in penetration of the knife portion into the insulation and thus the making of electrical connection of the insulated conductor with connecting terminals through both edges of the knife. In other words, electrical connection between the conductor material Wc of the insulated conductor W and connecting terminal 2 will be established at the two contact points $C_1$ and $C_2$. This electrical connection can be obtained with the aid of crimping action caused by the elastic restoring force of the blades at the slot 8, especially at said contact points $C_1$ and $C_2$ of the upstanding blades.

When insertion of the insulated conductor into the slot of the conductive conductor connecting terminal has been finished, a separate protective cover 3 is mounted. As shown in FIG. 1, said cover 3 is mounted onto the terminal block body by fitting the downward protrusion 9 and 9 at opposite ends of said cover into corresponding recesses 2' and 2' formed at opposite ends of the terminal block body 1 or with a plurality of screws at several points, i.e. four corners.

In this type of conventional slot-type terminal, electrical connection is made only at a pair of contact points between the pair of knife portions at both upright edges of the slot and the conductor material. The connection between the other portion of the conductor material and terminal at the crescent shaped portion R of the insulation may not be established, and thus, reliability of the connection will be degraded. Moreover, since the upstanding blades 6 and 6 crimp the related conductor material at said pair of contact points $C_1$ and $C_2$ only with elastic restoring force, force becomes concentrated at points $C_1$ and $C_2$. The conductor material will suffer extremely high stress and thus lead to bending of the conductor and to damaging or in the worst case, to breaking off of the conductor material. Otherwise, although immediate breaking off will not occur, occurrence and progression of the cracking at the contact point will lead to breaking off after a long period of use.

Also, in order to inspect any connection fault of the conductor from the conventional terminal block, the cover 3 should be removed. When the cover is removed, all conductors will be exposed at one time. Accordingly, careless treatment of the operator may cause electrical shorts and damage the related electrical equipment. Thus, careful treatment is required during inspection or maintenance. Thus, when opening or removing the cover, the power supply applied to all of the related electrical equipment except the equipment to be inspected should be turned off.

In order to simplify the manufacturing process of the terminal block, connecting terminal made of a conductive strip and having inverted U-shaped perpendicular portion at one end of the conductive strip has been proposed. Said perpendicular portion is formed with a slot.

As described hereinbefore, the conventional terminal block has the disadvantage of requiring careful handling and may cause breaking off of the conductor materials.

SUMMARY OF THE INVENTION

Therefore, an object of the present invention is to provide a slot-type terminal having enhanced connection reliability by providing a wide circumferential contact area between the conductor material and slots received with the conductor material while reducing the stresses from slot of the terminal onto the conductor material, and to provide terminal blocks employing this type of terminal.

In one embodiment of the present invention, there is provided a multi-connection terminal block including a plurality of electrically connecting terminal each of which provided with a respective cover, each said cover being comprised of fixed portion attached to the connector body and a movable portion, integral with the fixed portion, operable without any special tools, said terminal block body being provided with clamping hooks so as to snappingly hold the movable portions of the cover in position.

Also, the present invention provides a connector block which may prevents the bending of the terminal contacts, especially after finishing the connection, and establishes the connecting position of the conductor material.

In order to achieve said objects of the invention, the present invention provides that a slot type connecting terminal which may make connection between the conductor material of the insulated conductor and the slot with the aid of penetrating the slot type contacts, provided with knife blades at the upright members on one end thereof, into the insulation and contacting the conductor material therewith, through placing the insulated conductor in arrangement with the slot of terminal and pressing the conductor into said slot, characterized in that the slots have a semi-circular knife edge profile, at least the lower part thereof having a diameter substantially equal to that of the conductor material and said lower section of the slot forms knife edges which can penetrate the insulation of the conductor. According to the preferred embodiment of the invention, the upright members have an inverted U-shaped perpendicular portion, said slots are formed in longitudinal direction of the terminal and through said rising portion of the terminal.

In another embodiment of the invention, a terminal block employing the slot type terminal and respective covers each of which having protrusion on the bottom opposing each of the related slot, for holding and pressing the insulation of conductors and thus establishing the contact between the connector materials and the slots.

According to the other embodiment of the invention, there is provided a vertical cutout at the bottom of each slot and a horizontal cutout extending bidirectionally from and horizontally to the lower end of said vertical cutout.

According to a further embodiment of the invention, the upper portion over said semicircular portion is divergently tapered in view of the longitudinal direction of the terminal.

BRIEF DESCRIPTION OF THE DRAWINGS

The invention is described below in detail with reference to the accompanying drawings in which.

DESCRIPTION OF THE EMBODIMENTS

A description of the present invention will be made hereinbelow with reference to the other drawings.

Figure 4:
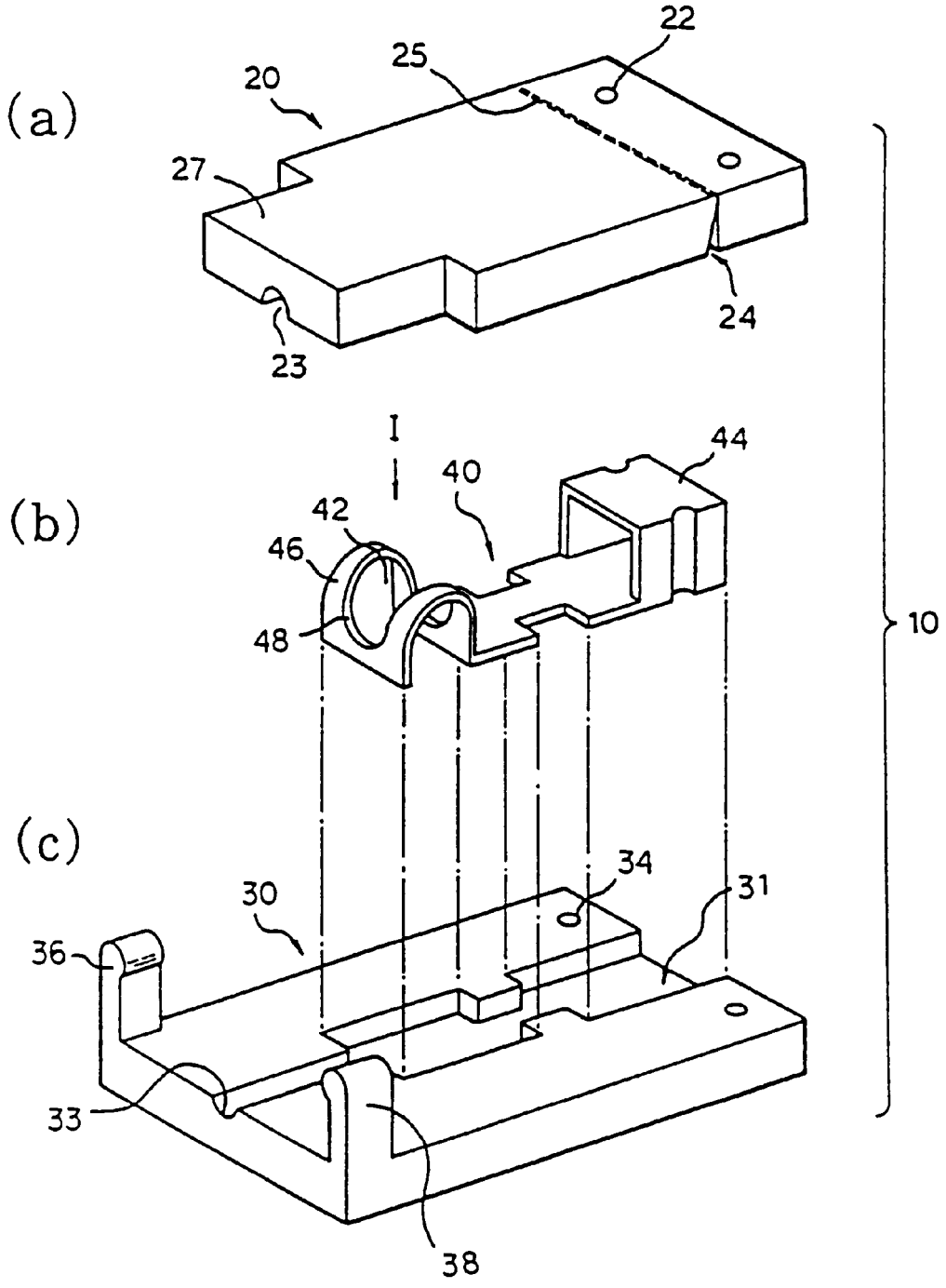
FIG. 4 is an exploded perspective view of the terminal block of a preferred embodiment of the present invention for connecting insulated conductor, (a) showing a terminal block cover, (b) showing a conductor connecting terminal, (c) showing a terminal block body.

FIG. 4 is an exploded view of the terminal block 10 showing a configuration of the terminal block 10 of the present invention composed of a terminal block cover 20, a slot type connecting terminal 40 and a terminal block body 30 formed with a recess for receiving the slot type conductor connecting terminal.

In the cover 20 of terminal block 10, an opening is formed in the vicinity of one end thereof and an inverted taper notch type scoring line 24 is formed transversely at a distance to the opening. Thus, the top surface 25 of the scoring line area 24 formed into thin film acts as a snap hinge which allows the turning of the movable portion about the scoring line.

In the terminal block body 30, there is formed a recess 31 for receiving a slot type conductor connecting terminal. Recess 31 will be aligned to the conductor receiving groove 33 formed in the body 30. Also, screw holes 34 corresponding to holes 22 of the cover 20 are formed into the block body 30. When assembling the cover 20 and body 30, screws (not shown) are inserted through these holes 22 and 34. For maintenance, inspection and conductor change, the operator can obtain access to the terminal by simply turning the movable portion 27 of the cover 20 about the snap hinge portion 25 without disassembling the whole cover 20 by unscrewing the screw. The other end of the terminal block body opposite the screw holes 34 has vertically oriented hooks 36, 38 on its opposite sides. The distance between the opposite hooks 36, 38 is substantially the same as the transverse width of the corresponding portion of the cover 20. At the top of each vertical hook, there is a snap shoulder at the same level with the height of the cover. Also, on each of the bottom surface of cover 20 and top surface of the terminal block body, there are respective conductor receiving grooves 23 and 33 for tightly holding the insulated conductor. In other words, closing the cover onto the body will fix the cover by snapping action of the shoulder to the top surface of the cover 20. Under these circumstances, since the diameter of the cylindrical hole to be formed by the conductor receiving grooves 23 of the cover 20 and the conductor receiving grooves of the body 30 are substantially less than the diameter of the insulated conductor, closing the cover after aligning the leading end portion of the conductor W above the groove 33 will provide for a reliable grip of the conductor. When desired, a waterproof gasket (not shown) may be provided on the bottom surface of the cover 20 and/or top surface of the terminal block body 30 as well as the conductor receiving grooves 23, 33 in order to provide waterproofing of the terminal block.

The slot type conductor connecting terminal 40 has inverted U-shaped vertical portion in the vicinity of its one end, and the rising portion has a slot 42 along its longitudinal direction. Slot 42 comprises an upper part and a lower part. The configuration of the lower part is semicircular, the diameter of which is substantially the same as the outer diameter D of conductor material and the angle formed is more than 180°. The upper part of the slot forms two opposingly disposed substantially vertical knife blades extending in parallel or converging in a downward direction. Thus, penetration of the knife blade into the lower half of insulation by pressing of the insulated conductor into the slot 42 of the connecting terminal 40 in the direction of the arrow I will make the connection between the conductor and connecting terminal 40.

The vertical portion has an enlarged recess portion on its center substantially larger than the outer diameter of the insulated conductor and the insulation will not be penetrated in the enlarged recess portion but only by the vertical knife blade of the slot when pressed down over the transition point between the enlarged portion and the vertical knife blade portion. A pin contact 44 for connecting with a pin type terminal is formed at another end of the terminal 40.

In order to make a secure connection of the conductor in spite of the movement of the extended portion of the insulated conductor, the conductor is securely fixed in the connecting terminal when the mounting screws are screwed into the cover 30 after inserting the leading portion of the insulated wire into the conductor receiving groove 33 terminal and mounting the cover 20 in place.

Figure 5A:
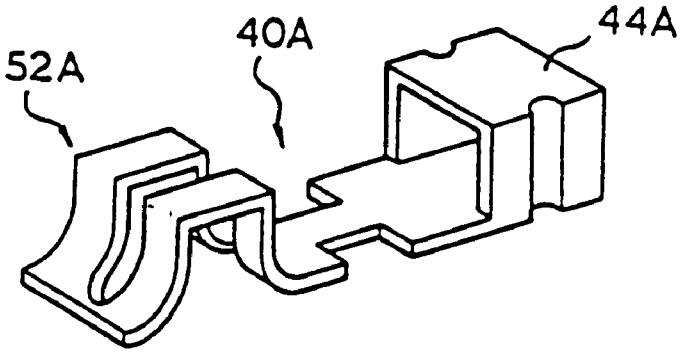
FIG. 5 is an exploded perspective view of another embodiment of (a) the terminal block body, the upper surface of rising portion being flat and (b) the conductor connecting terminal to be seated therein and being provided with supporting portion which can support the rising portion of the terminal block body.
Figure 5B:
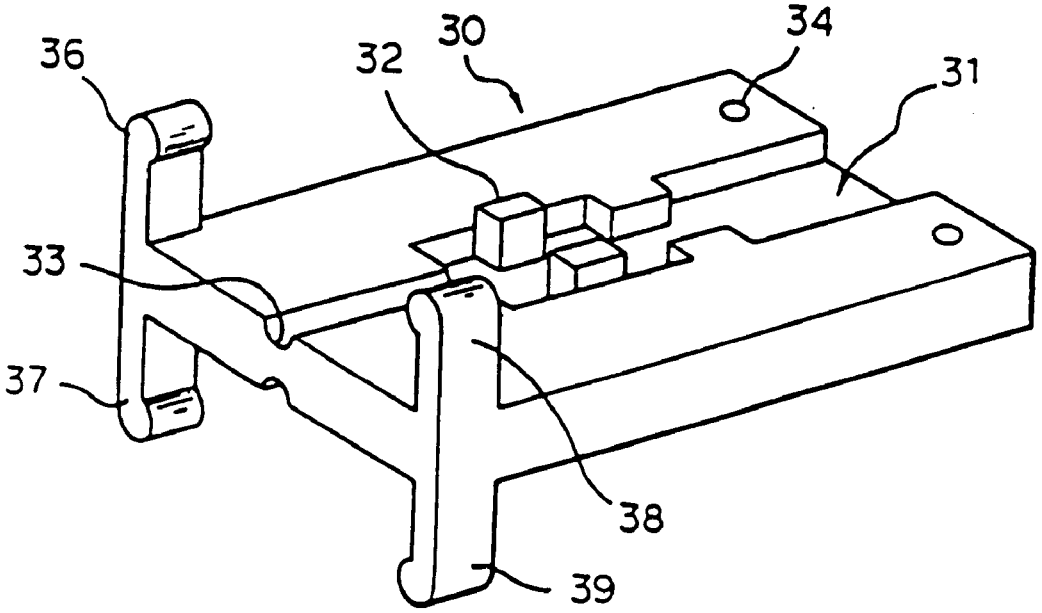

FIG. 5 is a perspective view of another embodiment of the terminal block body, in which (a) shows an embodiment wherein the upper surface of rising portion being flat and (b) shows an embodiment wherein the terminal receiving recess 31 of the conductor terminal block body 30 is provided with supporting portion 32 which can support the rising portion 52A of the connecting terminal 40A. This terminal block body 30 is formed with a terminal receiving recess and conductor receiving groove on the bottom surface thereof in order to make connection on the lower part of the terminal body. In this embodiment, there are also provided downwardly protruding hooks 37, 39 extending oppositely to the hooks 36, 38 described before on the lower surface of the terminal block body 30. The supporting portion 32 of the terminal block body 30 acts as a protection for the vertical portion to prevent bending or collapsing when the insulated conductor is inserted into the slot of terminal and leads to easy insertion and thus improved the reliability of the connection when the insulated conductor is pressed down into the slot.

It can be seen from FIG. 4 and FIG. 5 that pin contact members 44, 44A each include at one end the connecting terminals 40, 40A, and an inverted U-shaped rising portion on the other end. However, modification of the embodiment may be made by forming an inverted U-shaped vertical portion with a slot therein at both ends of the terminal. In addition to this, change of the location of the pin contact may be made. Also, other modification are possible by forming an inverted U-shaped rising portion with a slot therein at one end of the terminal and a plurality of inverted U-shaped vertical portions at the other end.

Figure 1:
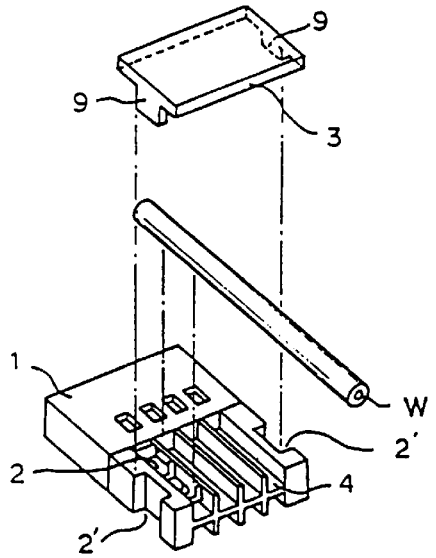
FIG. 1 PRIOR ART
FIG. 1 is an exploded perspective view showing the embodiment of the conventional terminal block for connecting the plurality of insulated conductor with the other component.
Figure 2:
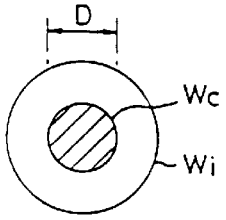
FIG. 2 PRIOR ART
FIG. 2 is a cross-sectional view of the insulated wire.
Figure 3:
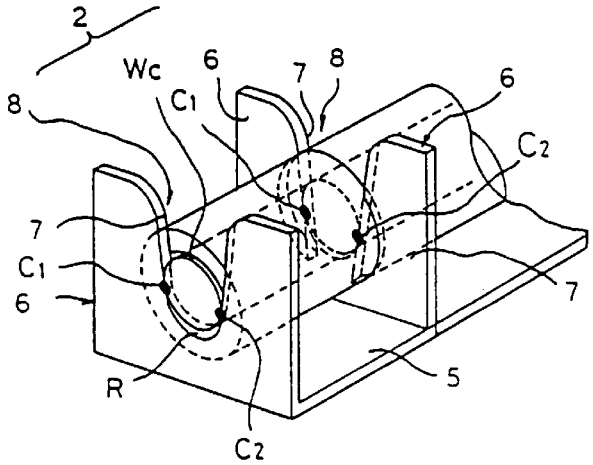
FIG. 3 PRIOR ART
FIG. 3 is an enlarged perspective view of the slot type terminal as shown in FIG. 1 after being connected with the insulated conductor.

Since the slot 42 of the connecting terminal 40 contacts at least the lower half of the conductor material, it would be superior in view of the interconnection and gripping action to those of the conventional connecting terminal 2, of which contact is made only at a pair of contact points $C_1$ and $C_2$ as shown in FIG. 3. In addition, in spite of application of any external forces, connection at the connecting terminal 40 is advantageously established with secure engaging force generated between the cover 20 and terminal block body 30 when a snug fit of the leading portion of conductor within the conductor receiving groove is achieved. If an inspection for maintenance or for confirming the state of connection is required, this embodiment does not require unscrewing the fixing screws, and only needs pulling back of both of the hooks 36, 38 and simply turning of the movable portion 27 of the cover 20 from the terminal block body 30.

Figure 6:
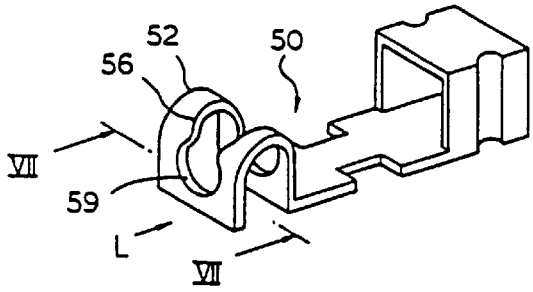
FIG. 6 is a perspective view of a further embodiment of the conductor connecting terminal.
Figure 7:
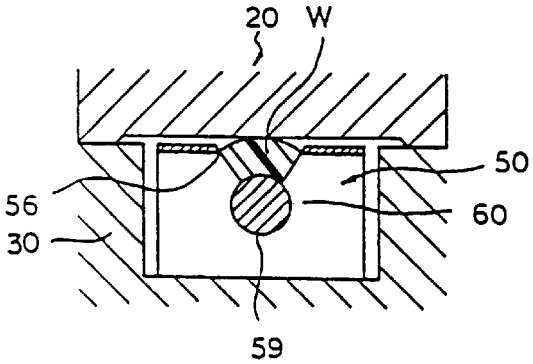
FIG. 7 is a cross-sectional view along with the line VII—VII in FIG. 6, showing the terminal body to which a terminal is seated and connection is finished and a cover closed thereon.

FIG. 6 shows a conductor connecting terminal 50 according to another embodiment of the invention. FIG. 7 is a cross-sectional view showing the combination wherein the terminal block body 30, to which a terminal 50 is seated, and a cover 20, and wherein the connection of conductor W into the slot of terminal 50 is finished and a cover 20 closed thereon. In this embodiment, the slot is comprised of a taper portion 56 and an arcuated portion 59, and both of said portions 56, 59 form knife blades. Accordingly, in the course of passing through tapered portion 56, the insulation of conductor is cut and penetrated by the knife blades of the slot on the terminal, lower half circle or more of said insulation will be cut out by the arcuated portion 59 of knife blade of slot and thus forming lower half circle or more of contact area when reached to the bottom of the slot. This results or secure connection covering a substantially wider area in comparison to the conventional connecting terminal of which contacting area is made only at a pair of contact points $C_1$ and $C_2$ leaving crescent shaped non-contacted area R.

Figure 8:
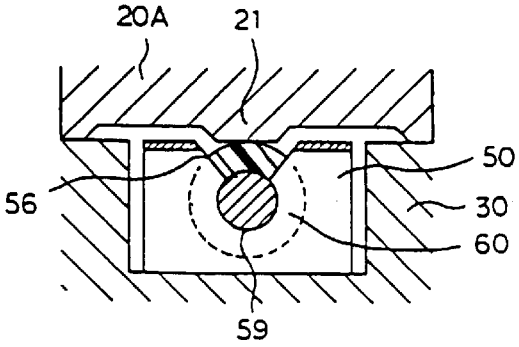
FIG. 8 is a cross-sectional view similar to FIG. 7 except that the terminal block cover has downward-extending protrusion for compressing and holding the insulated conductor in position.

FIG. 8 is a cross-sectional view showing an embodiment wherein the terminal block cover having a downward protrusion 21 for compressing and holding the insulated conductor in position is used in the combination of FIG. 7. Use of the downward protrusion 21 can make connection between the terminal 50 and the conductor W to be more secure and thus position of the conductor to be stabilized by weighing down of the insulated conductor into the slot of the connecting terminal 50.

Figure 9:
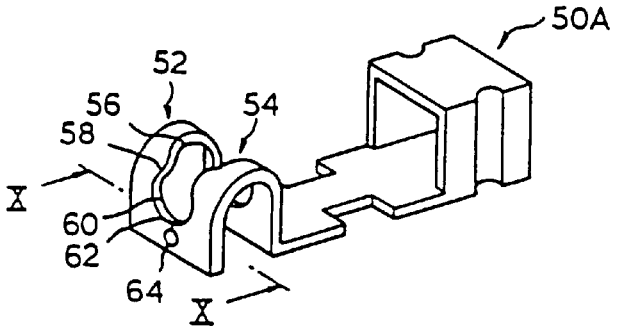
FIG. 9 is a perspective view of the conductor connecting terminal according to another embodiment of the invention.

FIG. 9 is a perspective view of the connecting terminal 50A having vertical cutout 62 extending from the bottom of the slot 54.

Figure 10:
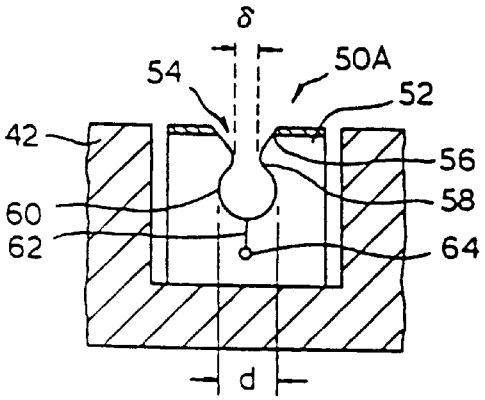
FIG. 10 is a cross-sectional view along the line X—X in FIG. 9 showing the condition that the conductor connecting terminal is seated onto the terminal block body and has a vertical cutout therein.

FIG. 10 is a cross-sectional view along with line X—X in FIG. 9 showing the condition that connecting terminal 50A is seated onto the receiving recess 31 of the terminal block body 30. The slot 54, formed in the vertical portion 52 of the connecting terminal 50A, is comprised of a downwardly converging tapered portion 56 and a circular portion 60 disposed thereunder. The arc of the circular portion 60 is more than 180° at the diameter D of the conductive material. Accordingly, since width of the trough 58 formed between the opposite ends of the arcuation is somewhat narrower than the diameter D of the conductor material, the conductor material will push out the trough in the course of pressing down the conductor. When the trough 58 is pushed out to expand the slot, the combination of a cutout 62 and a hole 64 positioned at the end of said cutout 62 will assist the expansion of the slot. When the expanding force is released after conductor material passes the trough 58, the slot will be restored its original shape, and thus, the conductor material will be set the arcuated portion 60. In this circumstance, tapered portion 56 of the slot will penetrate the insulation easier. The width δ of trough 58 is preferably as narrow as possible so that a substantial portion of the lower part of insulation is penetrated. However, making δ too narrow will cause an undesirable increase of the stress applied to the conductor material by the trough 58, as well as damaging said conductor material. Therefore, the width δ of trough 58 is preferably determined such that the shearing force applied to the conductor material, when passing through the trough 58, is somewhat relieved with the aid of any one or both of the vertical cutout 62 and hole 64 and thus there is penetration only of the insulation of the conductor.

Figure 11:
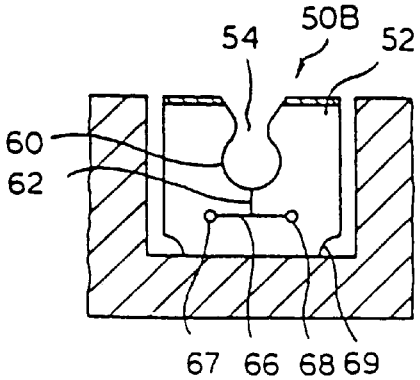
FIG. 11 is a cross-sectional view of the embodiment of the invention, similar to FIG. 10, in that the conductor connecting terminal further has a horizontal cutout and cutaway therein.

FIG. 11 is a cross-sectional view of the embodiment of the conductor connecting terminal 50B seated in the terminal block body 30 and having a horizontal cutout 66 extending horizontally opposite from the lower end of the vertical cutout 62 and a pair of holes 67, 68 at each terminal end of said cutout 66. With this horizontal cutout 66 in combination with the vertical cutout 62, passing through the trough will be made easier in comparison to the embodiment as shown in FIG. 10. In addition, making cutouts on each lower edges of the rising portion may make the pushing out of the slot easier.

Figure 12:
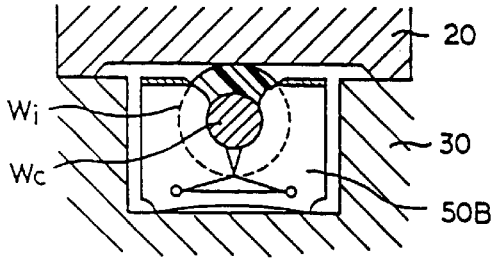
FIG. 12 is a cross-sectional view showing position in that conductor has been connected into the connecting terminal as shown in FIG. 11 and placed the cover thereon.

FIG. 12 is a cross-sectional view showing position in that conductor W has been connected into the connecting terminal 50B seated on the receiving recess of the terminal block body 30, as shown in FIG. 11, and placed the cover 20 thereon.

Figure 13:
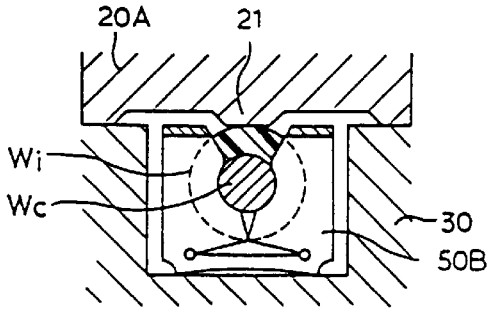
FIG. 13 is a cross-sectional view of the embodiment similar to that of FIG. 12 except that the terminal block cover has downward protrusion for compressing and holding the insulated conductor in position.

FIG. 13 is a cross-sectional view of the embodiment similar to that of FIG. 12 except that the terminal block cover 20A have downward protrusion 21.

When use of the cover 20A having downward protrusion 21 at the lower surface thereof is made as shown in FIG. 8 and FIG. 13, the location of the protrusion may be determined such that the protrusion is located at the front or rear point of the rising portion of the connecting terminal. Also, if there are a plurality of rising portions arranged longitudinally of the terminal, the protrusions may preferably be located therebetween.

In place of the vertical cutout 62 extending from the lower end of the arcuated portion of the slot and/or the horizontal cutout 66 extending from the vertical cutout 62, adoption of radially extending cutouts may be made. Also, the cutouts need not be linear and may be made as a slit having a width therein as long as the configuration which can facilitate the trough to be pushed out and relieving the stresses being applied on the terminal.

Figure 14:
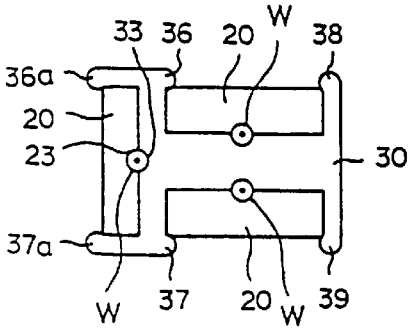
FIGS. 14 and 15 are diagrammatical end views of the embodiment of this invention having three or four connecting terminals in the position that the connection of the conductor has been finished.
Figure 15:
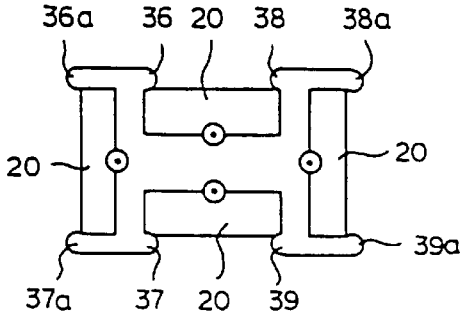
Figure 16A:
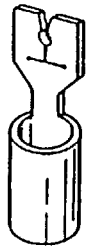
FIGS. 16 (*a*) to (*k*) shows selective embodiments adopting slot type contacts of the invention to the terminal end of various types of male or female pin connector.
Figure 16B:
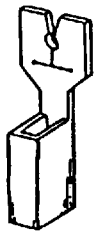
Figure 16C:
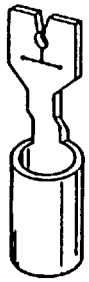
Figure 16D:
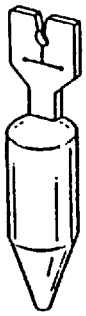
Figure 16E:
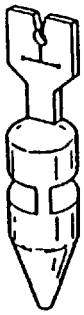
Figure 16F:
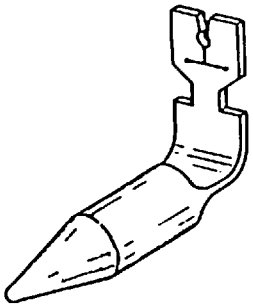
Figure 16G:
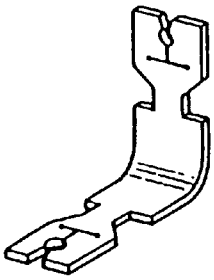
Figure 16H:
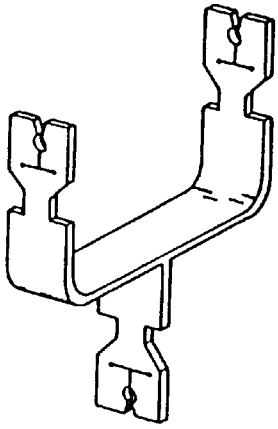
Figure 16I:
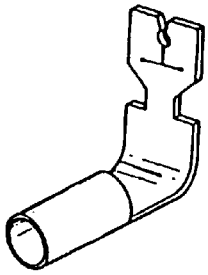
Figure 16J:
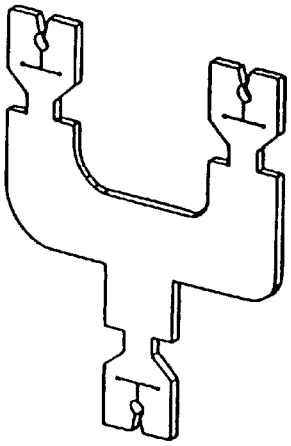
Figure 16K:
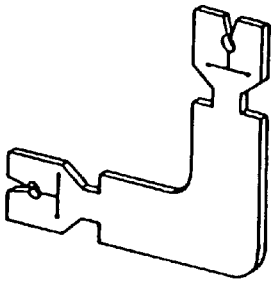

FIG. 14 and FIG. 15 are diagramatical end view of the embodiment having three or four connecting terminals in the position and each of the terminals having respective cover. FIG. 14 shows an embodiment wherein connection of three conductors has been made at upper, lower and side portions, whereas FIG. 15 shows another embodiment wherein connection of four conductors has been made at upper, lower and both side portions. As can be seen from FIG. 14, since the diameter of cylindrical bore, made from aligning of the conductor receiving groove 33 formed in the terminal block body 30 and corresponding groove 23 formed in the cover 20 by the abutment of the cover 20 and the block body 30, is somewhat less than the outer diameter of the insulated conductor, placing the cover in position will assist the establishment of the conductor's setting position. Each of the cover is placed and fixed onto the block body 30 in such a manner that the movable portion 27 on one side of the hinge having conductor receiving recess 23 is releasably mounted on the body 30 by the hooks formed on the terminal block body and the unmovable portion on another side of the hinge is mounted on the body 30 by a plurality of screws inserted through the holes in the vicinity of its one end. Thus, the movable portion 27 can be easily pulled and turned over by the pivoting movement about the hinge 25.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

For example, although the present embodiment adopts the connecting terminal 40 having a pin contact member 44 at one end thereof and an inverted U-shaped rising portion at another end thereof, the pin connecting member can be disposed at the center of the connecting terminal while disposing two inverted U-shaped rising portions at the opposite ends of the terminal.

Also, without preparing the U-shaped rising portion, use of vertical walls shown in FIG. 3 having slot of the present invention.

As an alternative embodiment, colored rubber packings, which can make distinction of conductors to be connected, may be placed on the conductor receiving grooves when the distinction of the polarity or function of conductors, i.e. + conductor, – conductor, and an earth conductor is required.

Also, as a further embodiment, seals may be applied to the one or both of the respective surfaces of the cover and those of the terminal block body, which will be abutted when closing the cover, to improve the water proof property. A plurality of the rising portion may be adopted in one terminal in order to enhance the reliability of connection. Use of a plurality of vertical cutouts and/or a plurality of radial cutouts as well as a slit type cutout or curved cutouts may be made.

In addition, although preferred embodiments using only one connecting terminal on one surface of the terminal block is illustrated and described hereinbefore, a plurality of connecting terminals may be used on one surface of the terminal block.

FIGS. 16 (*a*) to (*c*) are showing selective embodiments adopting slot type contact of the invention to the terminal end of various types of female pin connector, and (d) to (k) are showing selective embodiments for the various type of male connector. With these configurations, an improvement in connection reliability may be obtained and the reduction of stress being applied to the conductor material may be achieved.

I claim:

1. A slot type terminal block for use with an insulated conductor having conductor material surrounded by an insulation layer for making a connection with the conductor material, comprising:

a terminal including a base and an inverted U-shaped portion extending upwardly from the base, wherein the inverted U-shaped portion includes structure defining a longitudinally extending slot, including knife edges for penetrating the insulation material and making contact with the conductor material when the insulated conductor is moved into the slot, wherein the slot defines an arcuated profile, wherein the arcuated profile of the slot includes a lower portion and defines an arcuation angle greater than 180° and a diameter substantially equal to a transverse dimension defined by the conductor material, wherein the lower portion of the slot defines one or more knife edges for penetrating the insulation material;

a terminal block body having at least one terminal receiving recess for receiving the terminal, wherein the terminal block body includes a pair of upwardly extending opposing hooks; and a cover for covering and protecting the terminal block body, wherein the cover defines first and second ends and includes at least one fastener-receiving hole adjacent the first end and a groove adjacent the second end for receiving the conductor, wherein the hooks of the terminal block snappingly engage the cover at opposite sides adjacent the second end of the cover, and wherein the cover further includes a transverse scoring line formed by cutting off a portion of the height of the cover and leaving a relatively thin film of material of the cover at the scoring line;

wherein the terminal block body includes at least one fastener-receiving hole in alignment with the at least one fastener-receiving hole of the cover.

2. A slot type terminal block for use within an insulated conductor having a conductor material surrounded by an insulation layer for making a connection with the conductor material, comprising:

a terminal including a base and an inverted U-shaped portion extending upwardly from the base, wherein the inverted U-shaped portion includes structure defining a longitudinally extending slot having a first portion and a second portion, both portions having knife edges for penetrating the insulation material and making contact with the conductor material when the insulated conductor is moved into the slot, wherein the second portion of the slot defines an arcuated profile, wherein the arcuated profile of the second portion of the slot has a radius sized relative to a radius of the conductor material such that the knife edge of the second portion of the slot includes an arcuate end edge and the arcuate end edge of the slot engages the conductor material throughout the extent of the arcuate end edge;

a terminal block body having at least one terminal receiving recess for receiving the terminal; and a cover for covering and protecting the terminal block body.

3. The terminal block of claim 2, wherein the terminal block body defines a top surface having a conductor receiving groove formed therein with a cross-section corresponding to that of the insulated conductor, wherein the cover includes a conductor receiving groove opposite to that of the terminal block body and similarly configured thereto, such that the insulated conductor is received within a passage defined by the conductor receiving grooves when the cover is engaged with the terminal block body.

4. The terminal block of claim 2, wherein the cover defines one or more fastener-receiving holes and wherein the terminal block body includes one or more fastener-receiving holes in alignment with the fastener-receiving holes of the cover.

5. The terminal block of claim 4, wherein the cover defines a transverse score line formed by cutting off a portion of the height of the cover so as to leave a thin film of the cover at the scoring line.

6. The terminal block of claim 2, wherein the cover defines a bottom surface adapted for alignment with the slot of the terminal, and further includes a downward protrusion for pressing and maintaining the insulated conductor within the slot.

7. The terminal block of claim 2, wherein the slot is defined by upwardly and divergently tapered side edges.

* * * * *